United States Patent [19]

Bartella

[11] Patent Number: 5,054,132

[45] Date of Patent: Oct. 8, 1991

[54] FLUSH CONTROL SYSTEM FOR PLUMBING FIXTURE

[75] Inventor: Luigi F. Bartella, Weston, Canada

[73] Assignee: American Standard Inc., New York, N.Y.

[21] Appl. No.: 257,354

[22] Filed: Oct. 13, 1988

[51] Int. Cl.[5] ..... E03D 1/00; E03D 13/00

[52] U.S. Cl. ..... 4/302; 4/313

[58] Field of Search ..... 4/302, 313

[56] References Cited

U.S. PATENT DOCUMENTS

| | | | |
|---|---|---|---|
| 1,461,284 | 7/1923 | Newton | 4/302 |
| 2,283,678 | 5/1942 | Landis . | |
| 2,507,966 | 5/1950 | Filliung . | |
| 2,597,560 | 5/1952 | Beyrodt . | |
| 3,193,846 | 7/1965 | Lefebvre . | |
| 3,316,561 | 5/1967 | Newkirk . | |
| 3,524,204 | 8/1970 | Rusnok . | |
| 3,575,640 | 4/1971 | Ishikawa | 4/313 X |
| 3,590,397 | 7/1971 | Akamatsu et al. | 4/313 |
| 4,134,163 | 1/1979 | Matsunaga . | |
| 4,195,374 | 4/1980 | Morris et al. | |
| 4,309,781 | 1/1982 | Lissau . | |
| 4,471,498 | 9/1984 | Robertshaw . | |
| 4,570,272 | 2/1986 | Kawaguchi et al. | 4/302 |
| 4,616,368 | 10/1986 | Nagai et al. . | |
| 4,624,017 | 11/1986 | Foletta . | |

FOREIGN PATENT DOCUMENTS

| | | | |
|---|---|---|---|
| 1944165 | 3/1971 | Fed. Rep. of Germany . | |
| 2436611 | 2/1976 | Fed. Rep. of Germany . | |
| 5065905 | 1/1977 | Fed. Rep. of Germany . | |
| 5396322 | 8/1978 | Fed. Rep. of Germany . | |
| 3007925 | 10/1981 | Fed. Rep. of Germany . | |
| 3140307 | 8/1982 | Fed. Rep. of Germany . | |
| 2065190 | 6/1987 | United Kingdom | 4/313 |

*Primary Examiner*—Charles E. Phillips

*Attorney, Agent, or Firm*—John P. Sinnott

[57] ABSTRACT

A flush control system for a plumbing fixture is disclosed. The plumbing fixture includes electrical components which electrically operate a flush valve and are housed in the body of the plumbing fixture. A cover, which is normally closed, activates an electrical circuit, operably connected to a flush valve, when the cover is lifted by a user for a predetermined time. After the elapsed period of time, when the cover is lowered to its normal position, the flush valve is actuated and, for a second predetermined time, the flush valve will operate to complete its flush cycle.

7 Claims, 7 Drawing Sheets

FLUSH CONTROL SYSTEM FOR PLUMBING FIXTURE

BACKGROUND OF THE DISCLOSURE

1. Field of the Invention

This invention relates to a flush control system for a plumbing fixture and, more particularly, to an electrically operated flush valve controlled by the relative position of the cover or lid before starting the flush cycle.

2. Description of the Prior Art

Plumbing fixtures, such as toilets and urinals, both residential and commercial, employ various types of flush valve assemblies, both manual and electrically operated flush valves. Various means are employed for actuating an electrically controlled flush valve, for example: use of infrared and capacitance detection systems, wherein a flush cycle is completed after a single use. Also, mechanically or electrically operated toilet seats or covers which actuate the flush valve are known.

SUMMARY OF THE INVENTION

It is an object of the invention to provide a plumbing fixture, such as a residential urinal or toilet, having a closure assembly, wherein a flush valve is energized only after the lid or cover of the closure assembly is raised by the user for a predetermined time and when the use has been completed, the cover is lowered so that the flush valve is energized for an additional predetermined period of time to complete the flush cycle.

It is another object of the invention to provide a plumbing fixture, such as a residential urinal or toilet, in which the electrical components, including an electronic controller, an electrically operated flush valve, and valve actuating means are housed within the body of the plumbing fixture so that its installation is accomplished quickly and at low cost. Also, the components are accessible after installation if required for servicing, i.e., the components, electronics and valve, are not roughed in behind a finished wall.

A further object of the invention is to provide flush cycle adjusting means to control the volume of flush water used per cycle. This will allow for different flush cycle length requirements due to different pressure levels at each installation.

The invention generally contemplates providing a flush control system for a plumbing fixture in which the electrical components, including the electronic controller, electrically operated flush valve and valve switching means, are housed within the body of the plumbing fixture. The plumbing fixture includes a cover or lid which is mechanically coupled to the valve switching means to energize the valve from its normally closed position to its opened position. After a predetermined period of time has elapsed, the flush cycle is energized and will start when the cover or lid is shifted to its lowered or closed position. The flush valve is operable for a predetermined period of time to complete its flush cycle.

DETAILED DESCRIPTION OF THE PREFERRED EMBODIMENT

Figure 1:
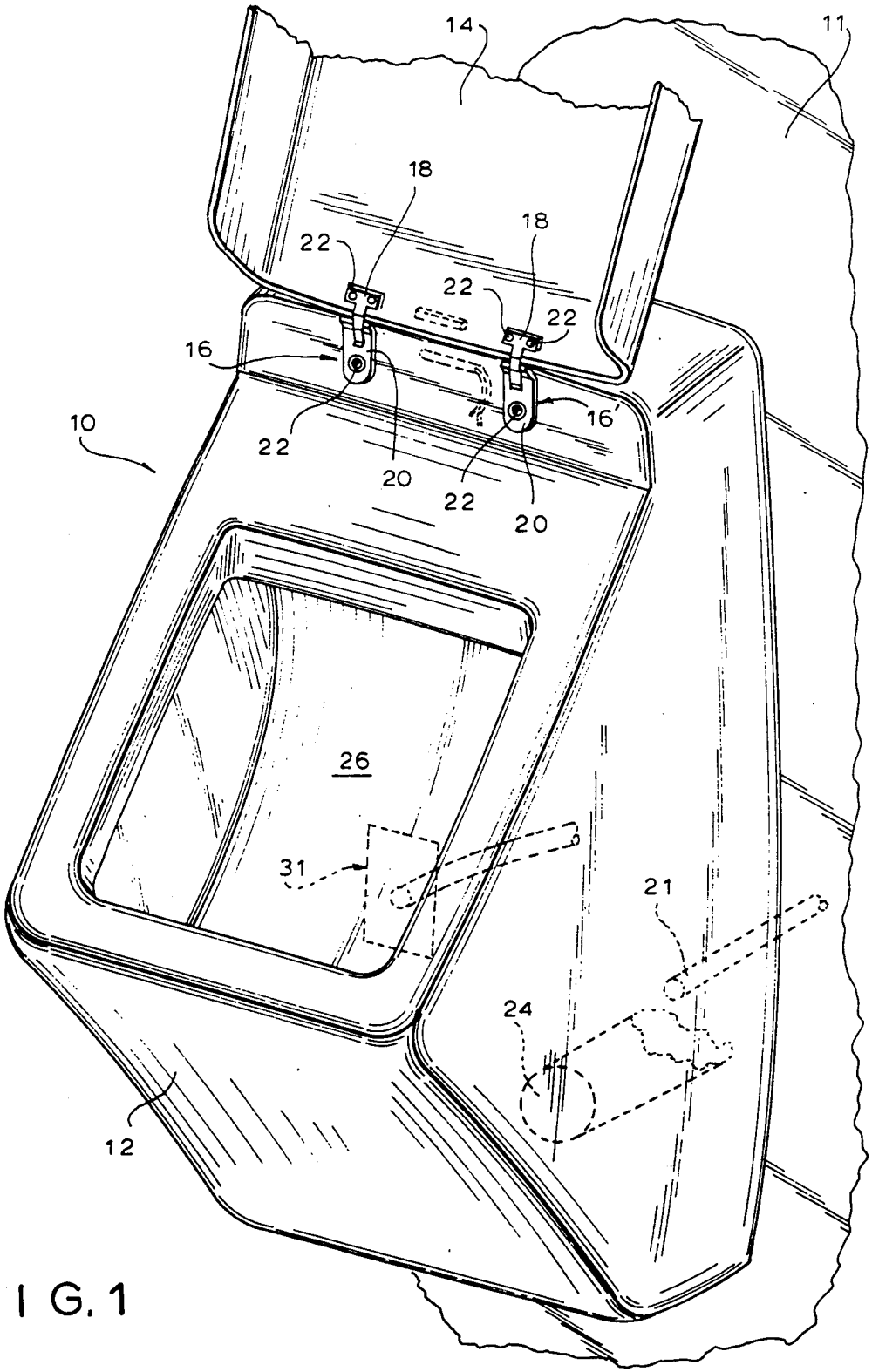
FIG. 1 is a perspective view of a residential urinal with its cover in its raised position, illustrating the flush control system of the present invention.
Figure 2:
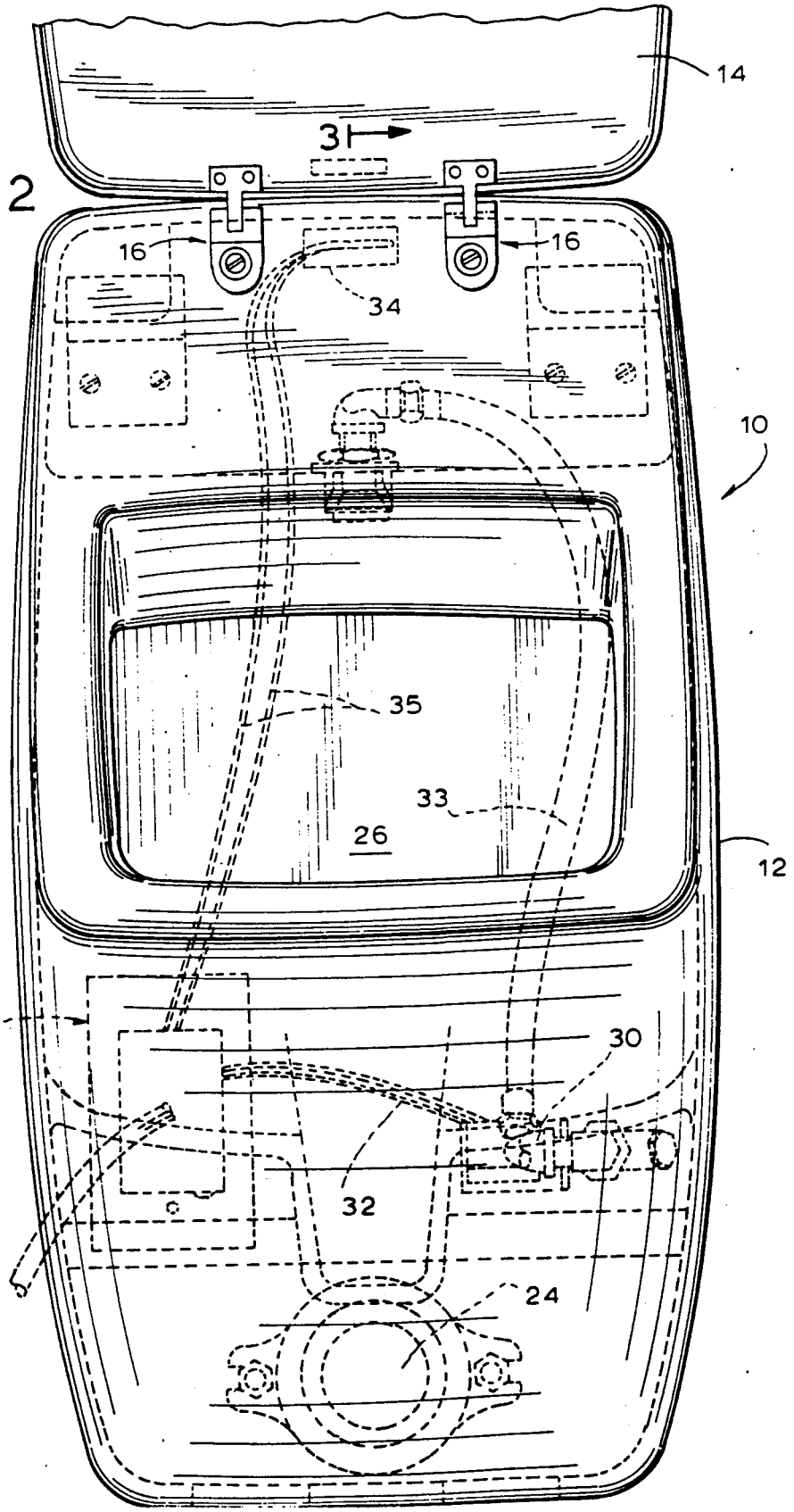
FIG. 2 is a front elevational view of FIG. 1 showing, in dotted lines, the electrical components and water conduits.

Referring to FIGS. 1–5, a residential urinal 10 includes a body 12 and cover 14 which is raised and lowered on hinges 16. Male leaf 18 is fastened to lid 14, and female leaf 20 is mounted to body 12 of urinal 10, as by screws or anchors 22.

Urinal 10 is preferably cast and fired to form a China body 12. Obviously, body 12 can be made of any moldable material, such as a suitable plastic. Shown most clearly in FIG. 3, urinal 10 is mounted against a wall surface 11 in which a drain or waste pipe 24 is coupled to the waste discharge passage 23 by a suitable coupling 25 to form a water tight seal. Bowl 26 includes a hollow rim 28 having a plurality of rim passages 29.

Bowl outlet 27 communicates with discharge passage 23. A water supply line 21 is connected to an electrically operated solenoid water valve 30 which is electrically connected to the electronic controller 31 through electrical conductors 32, shown in FIG. 4. A typical solenoid valve may be used, such as a 24 V AC 50/60 HZ, normally closed, with a flow rate of 3–5 GPM, which tolerates a minimum pressure differential of 5 psi, with maximum pressure differential of 125 psi, preferably housed in a forged brass body, and includes a diaphragm for control of water hammer, may be used. The valve is connected to a 120 V AC source, 60 HZ input, with a 24 V AC 10 watt output electronic controller 31. The flow cycle of the valve can be controlled through a timing circuit, not shown, of from 5 to 40 seconds, which is adjustable after installation. A magnetic type reed switch 34 is mounted in the urinal body 12 adjacent hinges 16. A magnet 19 mounted on lid 14, adjacent hinges 16, controls the action of the reed switch between its off and on positions. Reed switch 34 is electrically connected to the electronic controller 31 through electrical conductors 35. Electronic controller 31 is mounted to power supply box S in wall 11 and is connected to the solenoid valve 30 through electrical conductors 32.

Electronic controller 31 is a self-contained unit with logic circuit 36, encased in a solid epoxy resin, adjustment potentiometer 37 and transformer 38 mounted in a 0.050" thick anodized aluminum case which is designed to be mounted on a standard wall outlet box S and to protrude into the cavity of the urinal.

The A.C. power is connected to the logic circuit by means of 3 wires from the primary of the transformer 38. The transformer and the chassis are connected to earth ground.

Figure 3:
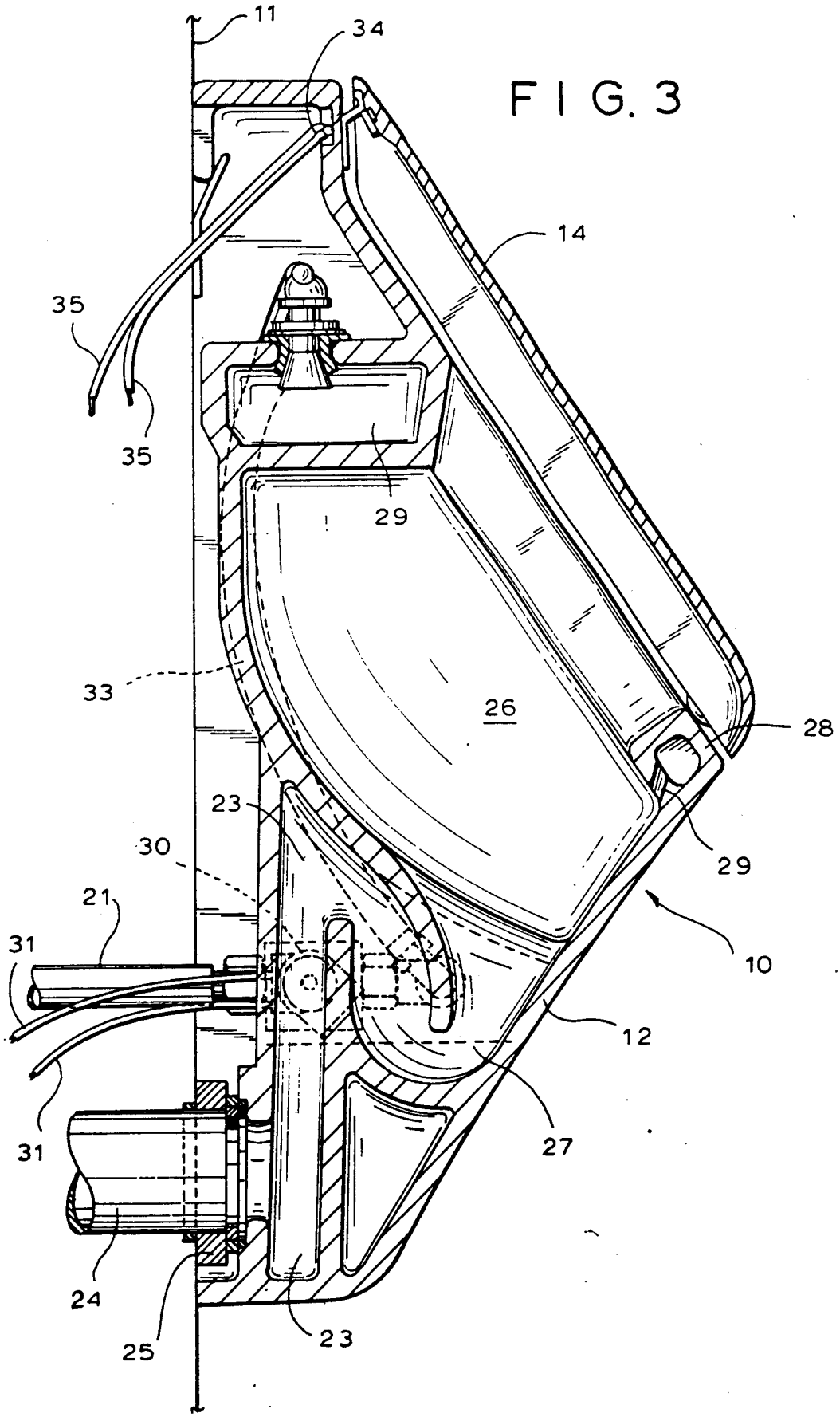
FIG. 3 is a sectional view, in elevation, taken along line 3—3 of FIG. 2.

When urinal 10 is to be used, cover 14 shown in its closed position, FIG. 3, is raised as shown in FIG. 1, which causes magnet 19 to disengage and electrically activate magnetic reed switch 34 to trigger the electronic controller 31 after a time delay of 5 seconds. The solenoid water valve 30 is energized after the cover is lowered; the reed switch is closed, which triggers the logic circuit to start the flush cycle and resets the water valve for its next cycle. However, solenoid water valve 30 will not start its flush cycle until cover 14 is lowered to its closed position, as shown in FIG. 3. When the use has been completed, after an elapse of 5 seconds, the cover is closed, solenoid water valve 30 is activated to complete its cycle, normally from 5 to 40 seconds. It should be noted that unless cover 14 is held in its raised position for at least 5 seconds, the time delay circuit will not energize solenoid water valve 30, thereby preventing a flush cycle from starting. This is to prevent unwanted flush cycles, for example: when a child raises the cover and then quickly lowers it, i.e. less than 5 seconds. If the cover is raised during the flush cycle, the flush cycle is not interrupted, i.e. the flush continues. If the cover is raised and lowered during the flush cycle, it will not cause a second flush cycle to occur. If the cover is raised during a flush cycle but lowered after the cycle is completed, then another flush cycle will occur. The flush cycle is adjustable by means of a flow adjustment screw accessible after installation through an opening, not shown, in the bottom of the urinal. In operation, water is conducted from its water supply line 21, through valve 30 up through water conduit 33, which discharges water to rim 28 and through passages 29. The amount of water discharged is sufficient to complete a sanitized flush.

Figure 4:
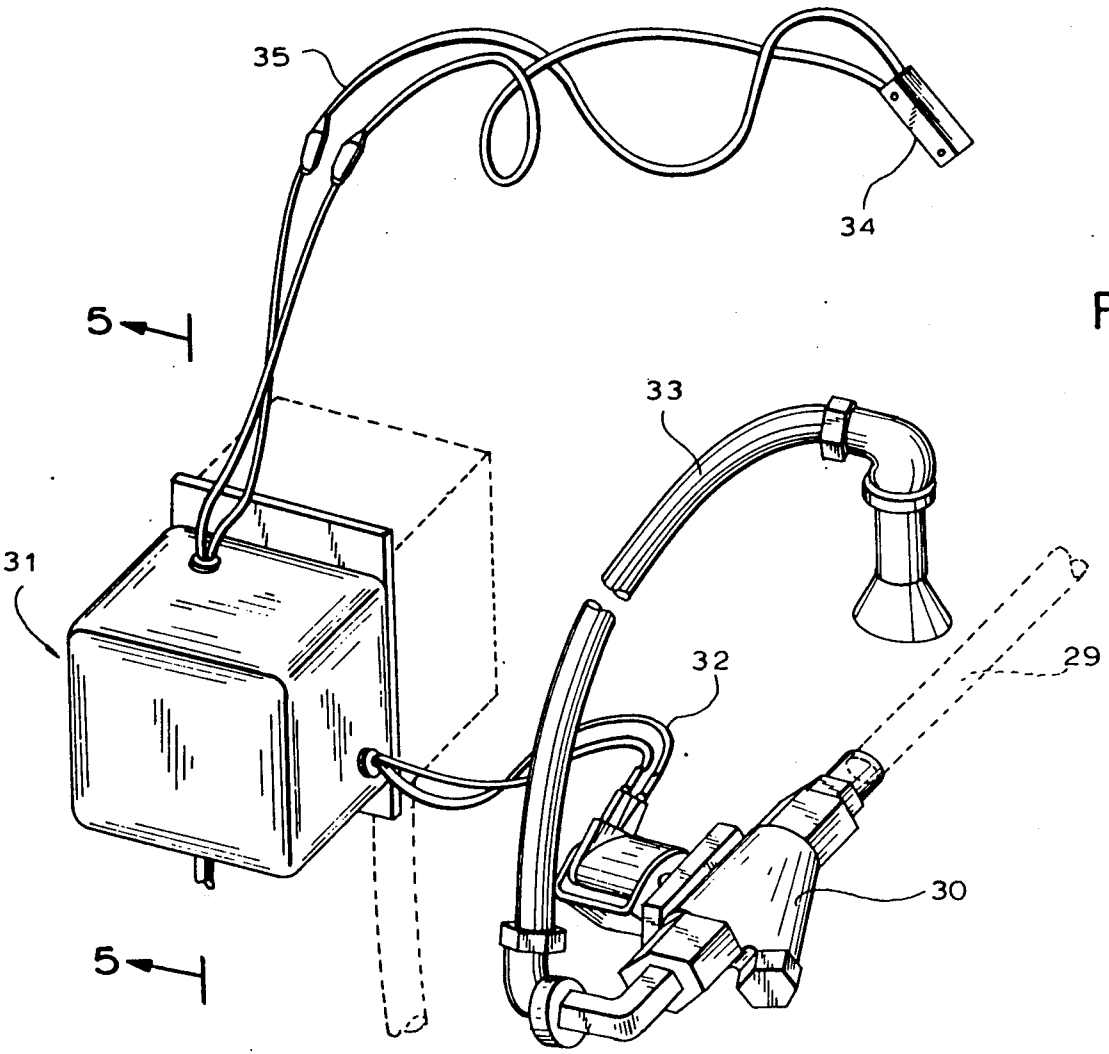
FIG. 4 is a perspective representation of the electrical components with the urinal broken away, shown in dotted lines of FIG. 2.
Figure 4A:
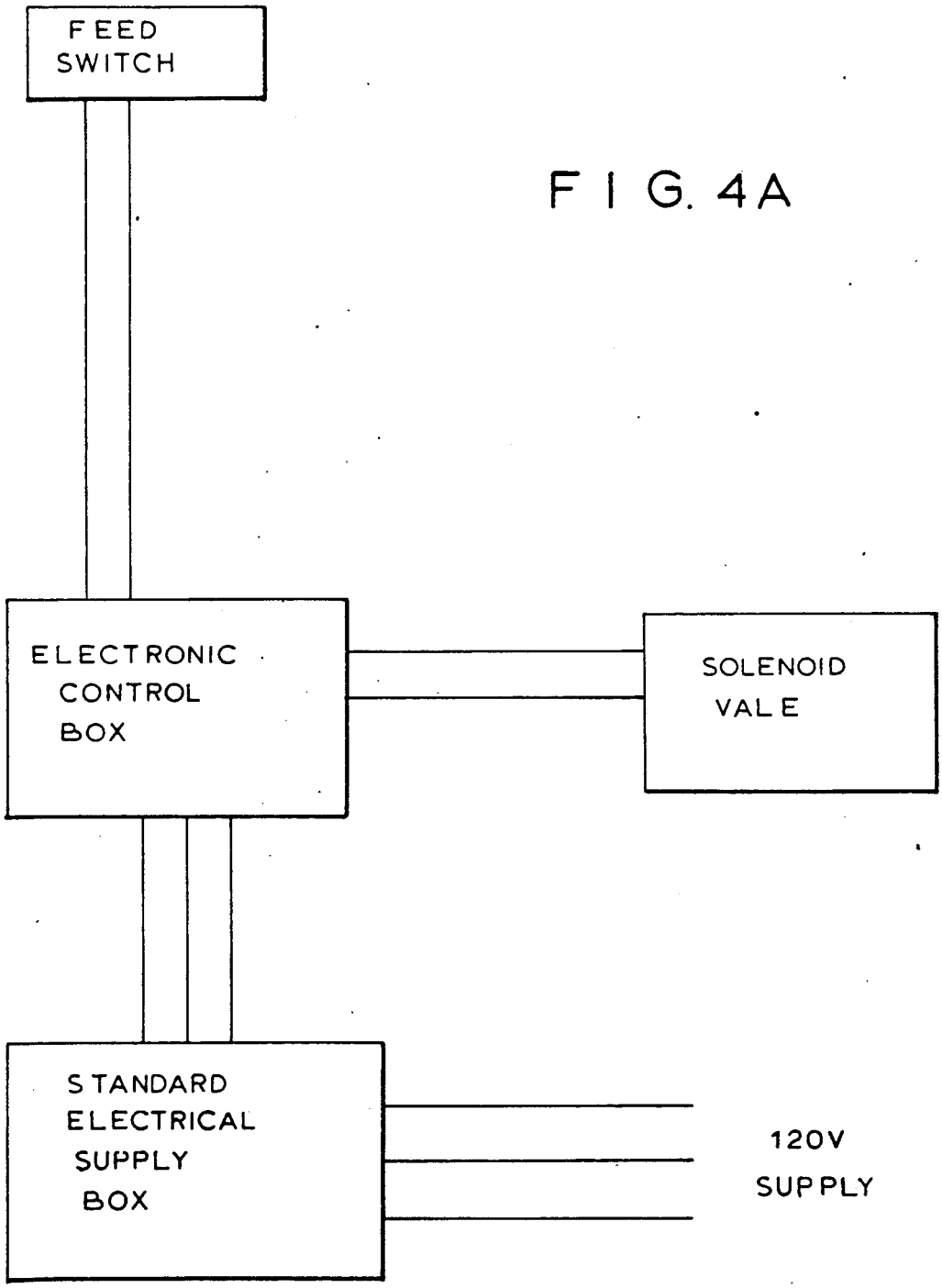
FIG. 4A is a block diagram of the electrical system which operates the electrical components shown in FIG. 4.
Figure 5:
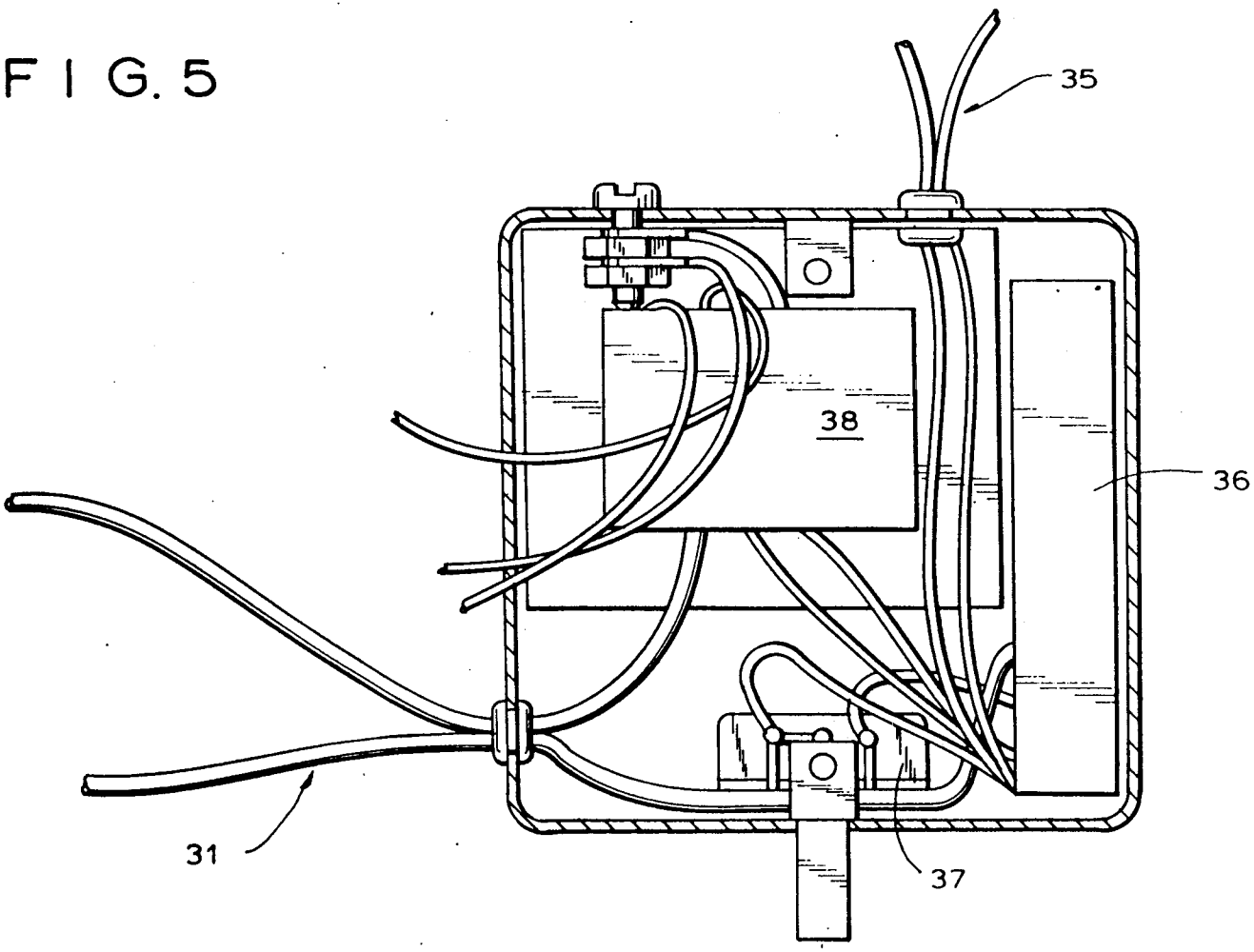
FIG. 5 is a an elevational view, in section, of the electronic controller, taken along line 5—5 of FIG. 4.
Figure 6:
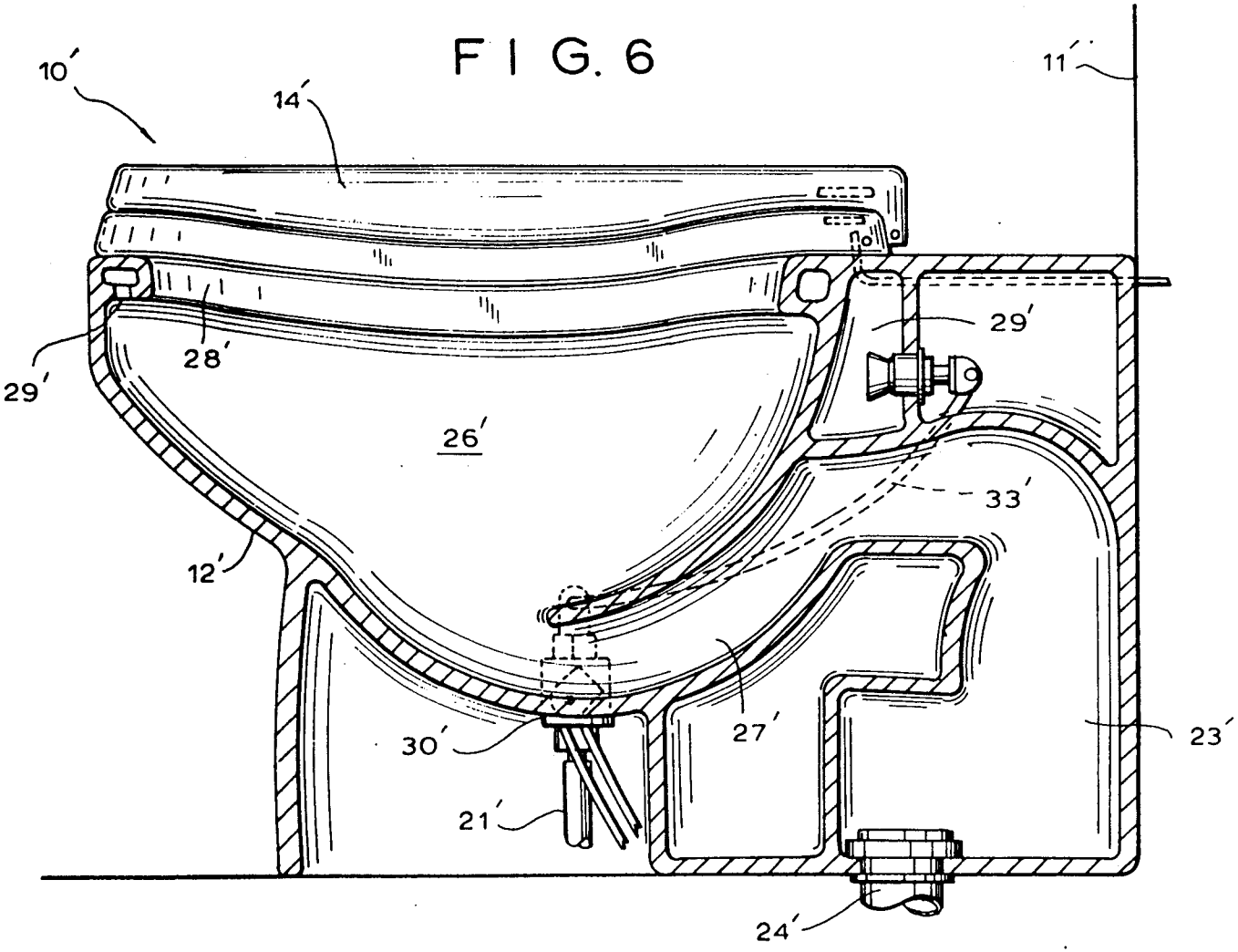
FIG. 6 is a sectional view, in elevation, of a toilet having the flush control system of the present invention.

Referring to FIG. 6, a toilet 10' is shown embodying the flush control system described in FIGS. 1–5. Therefore, like components will be described using primed numbers. The water supply line 21' is connected to an electrically operated solenoid valve 30', with water being conducted through water supply conduit 33', through rim 28', and out through rim passages 29' along the wall surfaces defining bowl 26', through bowl outlet 27', through waste discharge passage 23' and out through waste pipe 24'. The electrical components shown in FIG. 4, the electrical block diagram shown in FIG. 4A, and the electrical controller shown in FIG. 5 are the same, and are connected and operated in the same manner as previously described for urinal 10.

When toilet 10' is used, cover 14' shown in its closed position in FIG. 6 is raised, which causes magnet 19' to disengage and electrically activate magnetic reed switch 34' to trigger the electronic controller 31' which energizes solenoid water valve 30' after a time delay of 5 seconds. However, solenoid water valve 30' will not start its flush cycle until cover 14' is lowered to its closed position, as shown in FIG. 3. When the use has been completed, after an elapse of 5 seconds, the cover is closed, solenoid water valve 30' is activated to complete its cycle, normally from 5 to 40 seconds. In operation, water is conducted from its water supply line 21', through valve 30' up through water conduit 33', which discharges water to rim 28' and through passages 29'. The amount of water discharged is sufficient to complete a sanitized flush.

I claim:

1. A flush control system for use with a plumbing fixture of the type having a body defining a bowl, a waste outlet and water inlet opening communicating with said bowl, a cover hingedly connected to said body and moveable between a first position where said bowl is covered and a second position where said bowl is uncovered, said flush control system comprising:

an electronic controller means mounted in said body and adapted to be electrically connected to a power source, and which is electrically connected to a valve switching means and an electrically controlled solenoid water valve;

said solenoid water valve mounted in said body, having a water inlet opening adapted to be coupled to a water source and a water outlet opening, and a conduit coupled between said valve outlet opening and said bowl inlet opening;

said valve switching means mounted in said body and operatively coupled to a valve actuating means mounted in said cover so that when said cover is initially in its first position covering said bowl, said valve switching means is in its closed inoperative position, said electronic controller means acting to flush said bowl when said cover is raised to its second position for at least 5 seconds and then lowered to its first position thereafter, said valve switch means energizing said solenoid water valve through said electronic controller means to start the flush cycle only when the cover is shifted to its first position after having first been raised for at least 5 seconds to its second position.

2. The flush control system of claim 1 wherein said plumbing fixture is a urinal.

3. The flush control system of claim 1 wherein said plumbing fixture is a toilet.

4. The flush control system of claim 1 wherein said valve switching means is a reed switch.

5. The flush control system of claim 1 wherein said valve actuating means is a magnet mounted in said cover and positioned adjacent said valve switching means.

6. The flush control system of claim 1 wherein said electronic controller means includes a logic circuit so that said flush cycle is operative for at least 5 seconds to complete a sanitized flush.

7. The flush control system of claim 6 wherein said flush cycle is operative up to 40 seconds to complete a sanitized flush.

* * * * *